US005118050A

United States Patent [19]

Arnold et al.

[11] Patent Number: 5,118,050

[45] Date of Patent: Jun. 2, 1992

[54] LAUNCHER CONTROL SYSTEM

[75] Inventors: Keith P. Arnold, Canoga Park; Lawrence A. Humm, West Hills; Han S. Pan, Newbury Park; I-Ping Yu, Thousand Oaks; Robert Rosen, Granada Hill, all of Calif.

[73] Assignee: Hughes Aircraft Company, Los Angeles, Calif.

[21] Appl. No.: 568,298

[22] Filed: Aug. 16, 1990

Related U.S. Application Data

[63] Continuation-in-part of Ser. No. 447,320, Dec. 7, 1989.

[51] Int. Cl.[5] ..... F41G 7/28

[52] U.S. Cl. ..... 244/3.14; 244/3.19

[58] Field of Search ..... 244/3.14, 3.19

[56] References Cited

U.S. PATENT DOCUMENTS

| | | | |
|---|---|---|---|
| 3,987,447 | 10/1976 | Lockhart, Jr. et al. | 244/3.14 X |
| 4,093,153 | 6/1978 | Bardash et al. | 244/3.14 |
| 4,238,090 | 12/1980 | French | 244/3.19 |
| 4,383,661 | 5/1983 | Ottenheimer et al. | 244/3.14 |
| 4,730,794 | 3/1988 | Knauer | 244/3.14 |
| 4,997,144 | 3/1991 | Wolff et al. | 244/3.14 |
| 5,042,742 | 8/1991 | Hufault et al. | 244/3.11 |

*Primary Examiner*—John B. Sotomayor
*Attorney, Agent, or Firm*—C. D. Brown; R. M. Heald; W. K. Denson-Low

[57] ABSTRACT

In a weapon system 10 incorporating a target position sensor (14), an information system (16), a power source (22), a launcher (20), and an airborne vehicle (18), a launcher control system (12) which incorporates a communications interface (26) for coupling the information system (16) and the target position sensor (14) to a launcher (20) and an airborne vehicle (18). The communications interface (26) receives target position information and launch and control orders and provides launcher and airborne vehicle status. A airborne vehicle interface (28) couples the launcher (20) and the airborne vehicle (18) to the information system (16) and a power source (22). A transmitter (30) communicates updated target position information to the airborne vehicle after launch. A power control unit (32) converts and regulates power from different power sources (22) to be used by the launcher control system (12). The launcher (20) with launcher control system (12) is preferably modular in construction and is separate from the information system (16) and target position sensor (14).

16 Claims, 2 Drawing Sheets

LAUNCHER CONTROL SYSTEM

CROSS REFERENCE TO RELATED APPLICATIONS

This application is a continuation-in-part of U.S. Ser. No. 07/447,320 filed Dec. 7, 1989, issued which is hereby incorporated by reference.

BACKGROUND OF THE INVENTION

1. Technical Field

The present invention relates to missile launchers and, more specifically, to a launcher control system for controlling the launch and flight of an airborne vehicle.

2. Discussion

The purpose of a launching system is to place a weapon into a flight path as rapidly as required. Launching systems must perform with speed and reliability while displaying weapon system compatibility. However, system flexibility and performance is often limited by the design limitation of the launcher system to a specific environment, such as ground-to-air, ship-to-air, etc.

SUMMARY OF THE INVENTION

It is an object of the present invention to provide a standard launcher control system that can be employed in a multitude of environments, thereby expanding the useful environment of the weapon being deployed. In the preferred embodiment, the system is designed to control the launch and flight of what was originally designed exclusively to be an air-to-air missile, the Advanced Medium Range Radar Air-to-Air Missile (AMRAAM), although other embodiments envision this same concept being applied to any type of active radar guided airborne vehicle.

In accordance with the teachings of the present invention, a system for controlling the launch and flight of an airborne vehicle, is provided. The launcher control system is modular in construction, employing standard equipment, and is easily deployable in a variety of environments. It employs a communications interface for receiving target position information and launch control orders, and for providing launcher and airborne vehicle status information to an information system. An airborne vehicle interface couples the launcher control system to the launcher and airborne vehicle. The airborne vehicle interface provides power to the airborne vehicle for launch and data and control signals to test and launch the airborne vehicle, and determines the status of the airborne vehicle prior to launch. A transmitter for communicating updated target information to the airborne vehicle while in flight is also provided. Finally, the system employs a power converter for converting various forms of input power to power forms required by the launcher control system components. Regulation of system input power and overload protection for all system components is also provided.

BRIEF DESCRIPTION OF THE DRAWINGS

Other objects and advantages of the invention will become apparent upon reading the following detailed description and upon reference to the drawings, in which.

DETAILED DESCRIPTION OF THE PREFERRED EMBODIMENT

Figure 1:
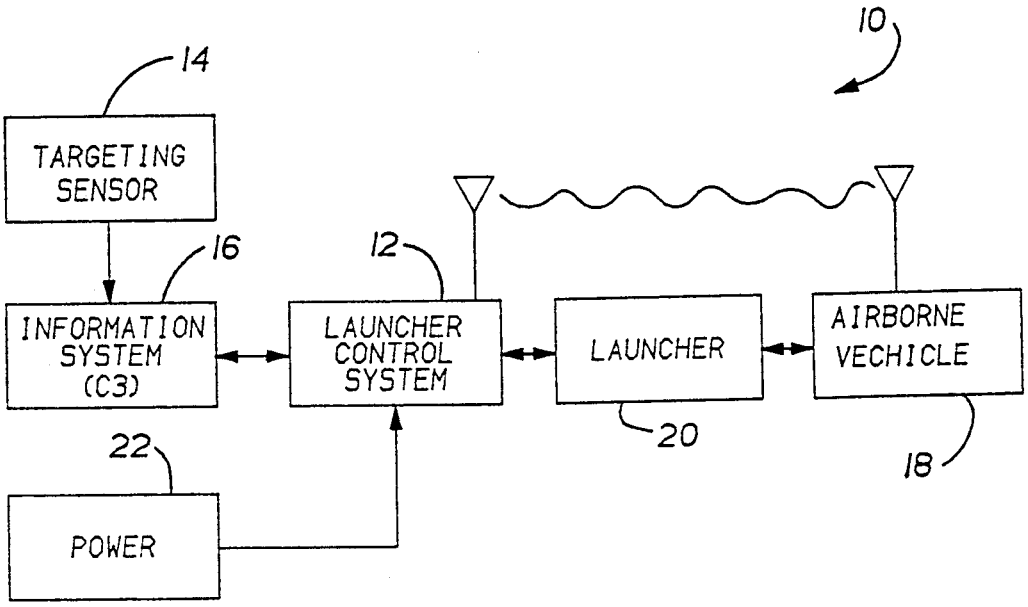
FIG. 1 is a schematic diagram of a weapon system incorporating the launcher control system.

Turning first to the weapon system 10 of FIG. 1, target position information is continuously obtained by a sensor 14, such as a radar system. This position information is processed by the information system 16, commonly referred to as the Communication, Command, and Control (C3) System, which generates position control signals for prelaunch testing and flight control of the airborne vehicle 18, such as a missile. Briefly, the C3 System is a combination of computer and communications technology and people. The communications technology collects and disseminates information, the computer technology processes the information, and people make decisions based on the information. The information system 16 is coupled to the launcher control system 12, which processes the position information and sends it to the airborne vehicle 18. Before launch, the airborne vehicle 18 receives position information and control signals through the launcher 20. In flight, the launcher control system transmits updated target position information to the airborne vehicle 18. The launcher control system 12 also monitors the prelaunch status of both the launcher 20 and the airborne vehicle 18 and relays the status information back to the information system 16. Power for operating the launcher control system 12 and for activating the airborne vehicle 18 during prelaunch checkout comes from power source 22.

Figure 2:
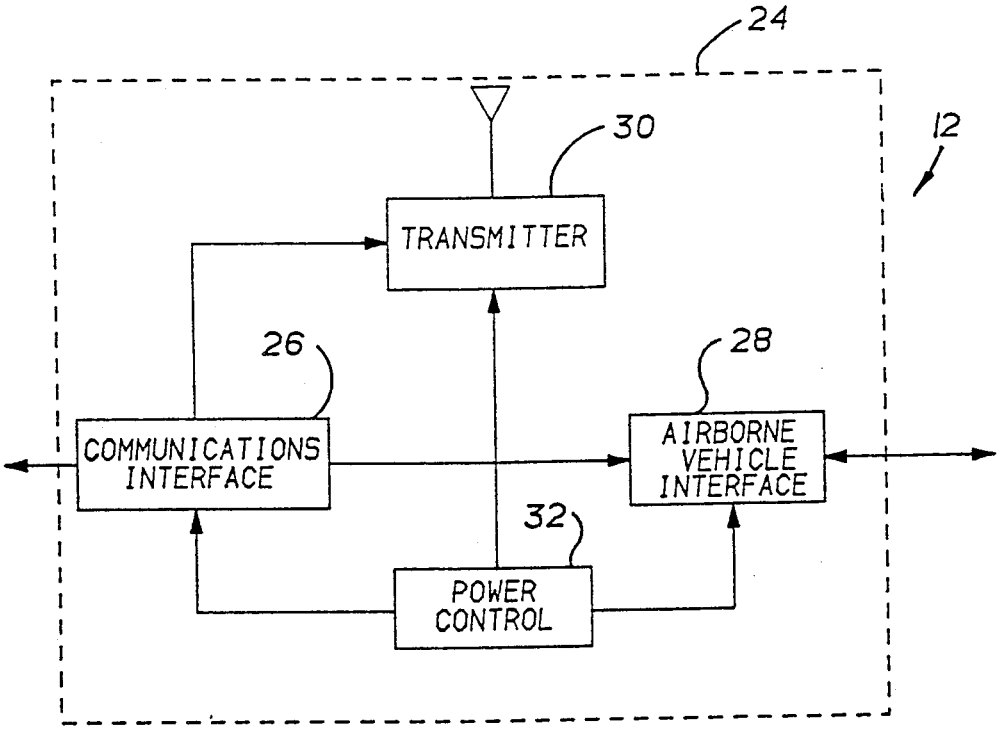
FIG. 2 is a block diagram of the launcher control system.

FIG. 2 illustrates the basic components of the launcher control system 12. The launcher control system 12 provides a standard communications interface 26 which missile from any information system 16 which has this standard interface. The communications interface 26 performs the interface function for target position information from the target sensor 14, and for launch and control orders from the information system 16. The communications interface 26 also provides launcher and airborne vehicle status back to the information system 16 prior to airborne vehicle launch.

The launcher control system 12 communicates with the airborne vehicle 18 in two ways. Prior to launch, the airborne vehicle interface 28 is used. In one embodiment, in which the airborne vehicle 18 is a missile, the commercially available MIL-STD 1760 interface advantageously allows the use of standard unmodified production missiles. The airborne vehicle interface 28 provides target position information and control signals for test and launch of the airborne vehicle 18 and provides power for airborne vehicle activation during the prelaunch checkout. It also determines the status of the airborne vehicle 18.

During flight, the launcher control system 12 communicates with the airborne vehicle 18 through a radio frequency (RF) data link transmitter 30. Target position information from the communications interface 26 is transmitted to the airborne vehicle. The launcher control system 12 provides 360° of data link coverage so that multiple simultaneous missile engagements can be managed over this full range.

The power control 32 supplies power to the communications interface 26, the transmitter 30, the airborne vehicle interface 28, the launcher 20, and the airborne vehicle 18. It converts available system power from the power source 22 to power forms required by these launch control system components. In addition, the power control 32 regulates launcher control system power and provides overload protection for all launcher control system components.

Figure 3:
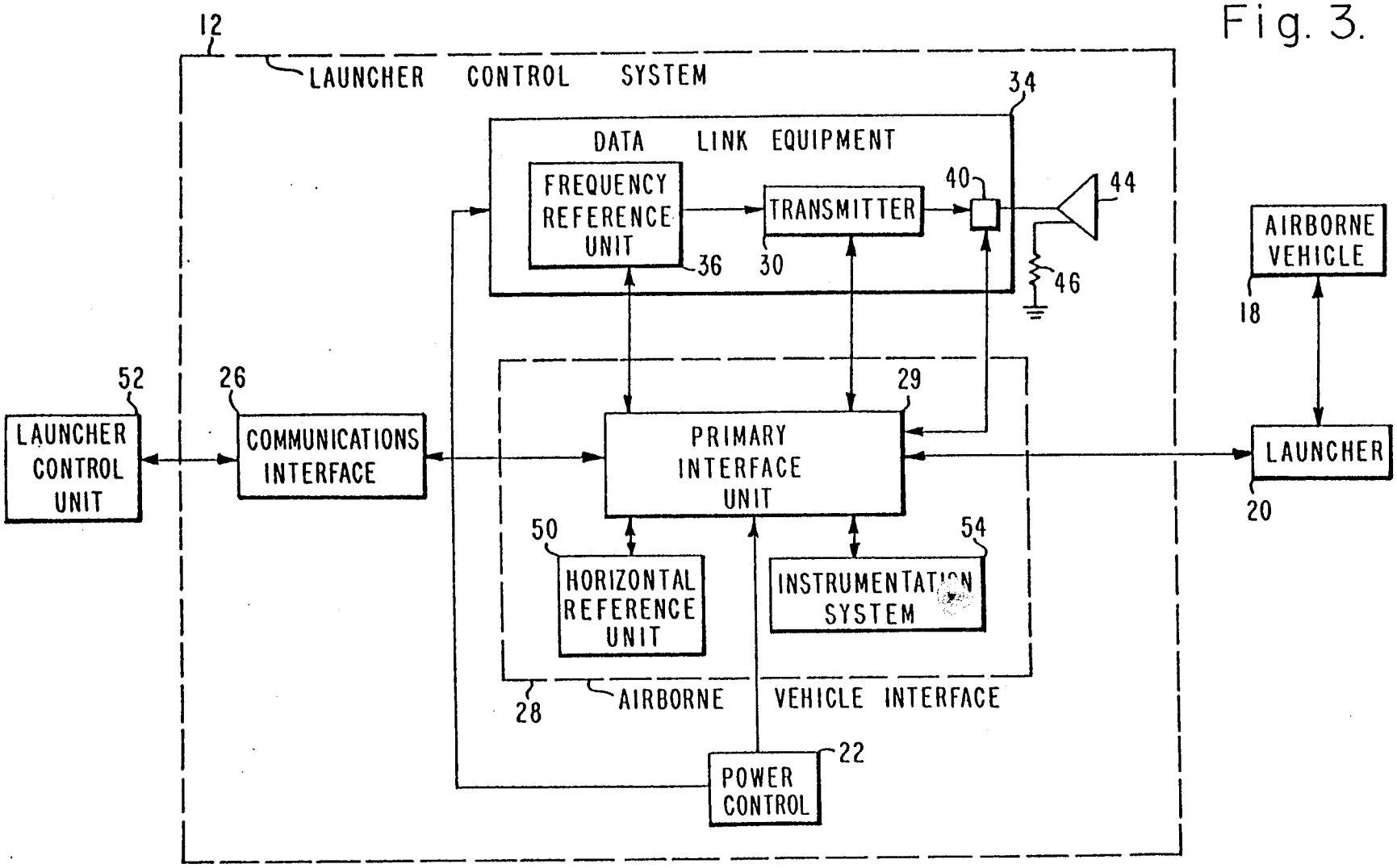
FIG. 3 is a block diagram of a specific embodiment of the launcher control system.

Turning now to FIG. 3, there is shown a more detailed embodiment of the launcher control system 12. Data link equipment 34 contains a frequency reference unit 36, a transmitter 30, and a load control switch 40. The frequency reference unit 36 is a variable frequency generator which produces a band of frequencies within the X-band of the electromagnetic spectrum. Frequency changes are made in fixed steps or intervals. Since it is capable of generating different frequencies, the frequency reference unit is less susceptible to jamming.

Transmitter 30 transmits the output signal from the frequency reference unit 36. It contains a travelling wave tube amplifier for amplifying the X-band electromagnetic signal.

The load control switch 40 directs the output of the transmitter 30 to the antenna 44 or a dummy load 46. The dummy load 46 is provided to allow for field tests of the data link equipment 34 without danger of spurious microwave radiation.

The antenna 44 employs four antenna subsystems each covering a 90 degree swath about the center of the antenna 44. Advantageously, the data link equipment 34 illuminates only the 90° swath in which the airborne vehicle 18 to be updated is located, thereby reducing spurious emissions. The antenna 44 is less susceptible to detection by unfriendly forces and the radiation from the antenna is less likely to interfere with other friendly radiation sources in the area. Additionally, only one-fourth the transmitter power is required.

The airborne vehicle interface 28 provides a variety of control functions throughout the launcher control system 12. It employs a primary interface unit 29 within the housing 24 which implements frequency change orders to the frequency reference unit 36, monitors the frequency reference unit for frequency drift, and performs a built-in test of frequency reference unit functions. It signals the transmitter 30 to transmit a pulse code to the airborne vehicle 18, monitors the output power of the transmitted pulse waveform, monitors the transmitter 30 for failure, and performs a built-in test function. It selects the antenna subsystem to be illuminated by the data link equipment 34. Finally, it implements a built-in test function for the horizontal reference unit 50.

A horizontal reference unit 50 is a subsystem of the airborne vehicle interface 28 located outside the housing 24 in this embodiment which measures the inclination of the launcher rotating platform. Pitch and roll information is sent via the primary interface unit 29 to the information system 16 where it is combined with the known global position of the launcher 20. This information about the orientation and position of the launcher rotating platform is important for missile targeting when using a remotely located targeting sensor 14.

Instrumentation system 54 is a subsystem of the airborne vehicle interface 28. It too is located outside the housing 24 in this embodiment. It is a data collection system used to monitor operation of the airborne vehicle interface 28.

The airborne vehicle interface 28 is coupled to the information system 16 through the communications interface 26, which employs one or more standard serial communications interface units and one or more discrete signal communications interface units. In this embodiment the standard communications interface is the RS-422. A multiplicity of communications interfaces provides safety and reliability, as control functions are separated from communications functions.

The airborne vehicle interface 28 communicates with the launcher 20 through a series of interfaces. A standard differential serial interface 1533 is used as well as several discrete interfaces. This multiplicity of interfaces also insures safety and reliability.

The power distribution unit 32 provides 28 volt DC power to the data link equipment 34 and the airborne vehicle interface 28. It receives three-phase 400 Hertz power from power source 22. Three-phase 400 Hertz power is also sent to the airborne vehicle interface 28. Three-phase power and 28 volt DC power are sent to the launcher 20 via the airborne vehicle interface 28.

Within the information system 16 there is a launcher control unit 52. The launcher control unit 52 implements the firing orders of the operator and implements self-test functions for the airborne vehicle interface 28. It also relays targeting information to the airborne vehicle interface 28.

The launcher 20 with the launcher control system 12 is normally located apart from the information system 16 and target sensor 14, thereby making the launcher 20 and the airborne vehicle 18 less vulnerable to destruction by enemy forces. It has a housing 24 and is modular in design, thereby facilitating repair and replacement of components. Because it is a standard interface box, the launcher control system 12 is capable of being used to control an airborne vehicle 18, such as the AMRAAM, in many other environments besides air-to-air. Finally, many such launcher control systems are capable of being linked to a common information system 16 to allow the simultaneous launch of multiple airborne vehicles, such as active radar missiles of the AMRAAM type. These advantages over the prior art are readily apparent to one skilled in the art.

Although the invention has been described with particular reference to certain preferred embodiments thereof, variations and modifications can be effected within the spirit and scope of the following claims.

What is claimed is:

1. An apparatus for controlling an airborne vehicle, said apparatus being part of a system including a target position sensor, an information system, a power source, and a launcher, said apparatus comprising:

(a) communications interface means for coupling the information system to the launcher and airborne vehicle;

(b) guidance means for communicating with the airborne vehicle after launch;

(c) power control means for coupling said power supply to said communications interface means, to an airborne vehicle interface means, and to said guidance means;

(d) airborne vehicle interface means comprising:

(i) primary interface means for receiving target position information and control signals from said communications interface, and providing same to said launcher for test and launch of said airborne vehicle; and for receiving power from said power control means and providing same to said launcher for activating said airborne vehicle; and for determining the status of said airborne vehicle;

(ii) horizontal reference means, coupled to said primary interface means, for measuring the inclination of the launcher;

(iii) instrumentation means coupled to said primary interface means for collecting data used to monitor operation of the primary interface means; and (e) housing means for enclosing said communications interface means, said airborne vehicle interface means, said guidance means, and said power control means.

2. The apparatus of claim 1 wherein said communications interface means receives target position information from said target position sensor and launch and control orders from said information system and provides launcher and airborne vehicle status information to the information system.

3. The apparatus of claim 1 wherein said communications interface means comprises a standard RS422 serial interface.

4. The apparatus of claim 1 wherein said communications interface means comprises a discrete signal interface.

5. The apparatus of claim 1 wherein said guidance means comprises a transmitter for transmitting target position information to said missile.

6. The apparatus of claim 1 wherein said guidance means comprises:

(a) a radio frequency (RF) data link transmitter;

(b) frequency reference means for generating an X-band electromagnetic signal containing guidance information to be transmitted by said data link transmitter;

(c) antenna means coupled to said data link transmitter for radiating guidance information to the airborne vehicle; and (d) load control means for coupling said X-band electromagnetic signal to said antenna means or to a dummy load.

7. The apparatus of claim 6 wherein said frequency reference means is tunable to a plurality of X-band electromagnetic signals.

8. The apparatus of claim 6 wherein said antenna means comprises:

(a) a plurality of antennas oriented in a circle, the radiation patterns of said antennas adding to provide an omnidirectional radiation pattern; and (b) antenna selection control means for coupling said data link transmitter to one of said antennas, said airborne vehicle being within the radiation pattern of said one antenna.

9. The apparatus of claim 1 wherein said power control means converts power from different power sources to power required by said communications interface means, said airborne vehicle interface means and said guidance means.

10. The apparatus of claim 1 wherein said housing means comprises a box-like container, being portable and separate from said target position sensor and said information system.

11. The apparatus of claim 1, being modular in construction with said communications interface means, said airborne vehicle interface means, said guidance means, and said power control means being easily removable and replaceable.

12. The apparatus of claim 1 wherein said airborne vehicle is a missile.

13. An apparatus for controlling an airborne vehicle, said apparatus being part of a system comprising a target position sensor, an information system, a power source, and a launcher, said apparatus comprising:

(a) communications interface means for coupling the information system to the launcher and airborne vehicle, said communications interface means receiving target position information from said target position sensor and launch and control orders from said information system, and providing launcher and airborne vehicle status information to the information system, said communications interface means including a plurality of serial interfaces;

(b) airborne vehicle interface means for coupling said communications interface means and said power source to said launcher and said airborne vehicle, said airborne vehicle interface means including a primary interface means for providing target position information and control signals for test and launch of said airborne vehicle and power from said power control means, for activating said airborne vehicle, and for determining the status of said airborne vehicle, said airborne vehicle interface means further including horizontal reference means coupled to said primary interface means for measuring the inclination of the launcher, and instrumentation means coupled to said primary interface means for collecting data used to monitor operation of the primary interface means;

(c) guidance means for communicating with the airborne vehicle after launch, said guidance means including a radio frequency data link transmitter, frequency reference means for generating an X-band electromagnetic signal having guidance information to be transmitted by said data link transmitter, antenna means coupled to said data link transmitter for radiating guidance information to the airborne vehicle;

(d) power control means for coupling said power supply to said communications interface means, said airborne vehicle interface means, and said guidance means, said power control means being capable of converting power from different power sources to power required by said communications interface means, said airborne vehicle interface means, and said guidance means; and (e) housing means for enclosing said communications interface means, said airborne vehicle interface means, said guidance means, and said power control means, said housing means comprising a box-like container being portable and separate from said target position sensor and said information system;

said apparatus being modular in construction with said communications interface means, and airborne vehicle interface means, said guidance means, and said power control means being easily removable and replaceable.

14. The apparatus of claim 13 wherein said airborne vehicle is a missile.

15. The apparatus of claim 13 wherein said antenna means comprises:

(a) a plurality of antennas oriented in a circle, the radiation patterns of said antennas adding to provide an omnidirectional radiation pattern; and (b) antenna selection control means for coupling said data link transmitter to one of said antennas, said airborne vehicle being within the radiation pattern of said one antenna.

16. The apparatus of claim 13 wherein said frequency reference means is tunable to a plurality of X-band electromagnetic signals.

* * * * *